United States Patent [19]

Watanabe et al.

[11] 4,227,923

[45] Oct. 14, 1980

[54] PLASTIC MOLDING STEEL HAVING IMPROVED RESISTANCE TO CORROSION BY HALOGEN GAS

[75] Inventors: Toshiyuki Watanabe, Nishio; Hisao Kamiya, Kariya; Noriyoshi Shibata, Chita; Takayoshi Shimizu, Tokai, all of Japan

[73] Assignee: Daido Seiko Kabushiki Kaisha, Nagoya, Japan

[21] Appl. No.: 964,050

[22] Filed: Nov. 27, 1978

Related U.S. Application Data

[63] Continuation of Ser. No. 830,789, Sep. 6, 1977, abandoned, which is a continuation of Ser. No. 700,030, Jun. 25, 1976, abandoned.

[51] Int. Cl.[2] ..... C21D 9/00; C22C 39/20

[52] U.S. Cl. ..... 75/125; 75/128 A; 75/128 B; 75/128 E; 75/128 P; 75/128 R; 75/128 W; 75/128 V; 148/38

[58] Field of Search ..... 148/38; 75/128 A, 128 B, 75/128 E, 128 F, 128 G, 128 T, 128 V, 128 W, 128 R, 125

[56] References Cited

U.S. PATENT DOCUMENTS

| | | | |
|---|---|---|---|
| 2,009,713 | 7/1935 | Palmer | 75/128 P |
| 2,553,330 | 5/1951 | Post et al. | 75/122 |
| 3,512,960 | 5/1970 | Brady et al. | 75/128 B |
| 3,574,601 | 4/1971 | Myers et al. | 75/125 |
| 3,658,513 | 4/1972 | Clarke, Jr. | 75/125 |
| 3,915,756 | 10/1975 | Oda et al. | 75/128 B |

FOREIGN PATENT DOCUMENTS 535791 1/1957 Canada .

OTHER PUBLICATIONS

Merriman, "A Dictionary of Metallurgy" 1958, pp. 180–181.

Stahlschlüssel, 10th Ed., 1974, p. 6.

*Primary Examiner*—L. Dewayne Rutledge
*Assistant Examiner*—Upendra Roy
*Attorney, Agent, or Firm*—Stevens, Davis, Miller & Mosher

[57] ABSTRACT

A steel which is suitable for the material of a mold used for plastic molding and which has an improved resistance to corrosion under exposure to a halogen gas generated in injection molding of a thermoplastic synthetic resin blended with a halogen-containing flame-retarding agent is obtained by shaping a steel which consists essentially of up to 0.05% carbon, up to 1.0% silicon, up to 2.0% manganese, 5.0–8.0% nickel, 11.0–15.0% chromium, 1.0–4.0% molybdenum, 0.5–4.0% copper, 0.5–2.0% cobalt and the balance iron into a mold, and then subjecting the mold to age-hardening treatment at a temperature in the range of 400°–450° C. to obtain a hardness of $H_RC$ 30 or higher. The steel may further contain a small, predetermined amount of at least one machinability-improving component such as lead, tellurium, calcium and bismuth and/or a small, predetermined amount of at least one toughness or hardness-improving component such as tungsten, boron, titanium, vanadium, niobium and tantalum.

4 Claims, 6 Drawing Figures

INJECTION MOLDING CONDITIONS
MACHINE: MEIKI MS-16(1 OZ.)
RESIN: TUFFLEX (FLAME-RESISTANT RESIN)
RESIN TEMP: 197±2°C

PLASTIC MOLDING STEEL HAVING IMPROVED RESISTANCE TO CORROSION BY HALOGEN GAS

This is a continuation of application Ser. No. 830,789 filed Sept. 6, 1977 abandoned which in turn is a continuation of application Ser. No. 700,030 filed June 25, 1976, abandoned.

BACKGROUND OF THE INVENTION

The present invention relates to a mold for plastic molding having improved resistance to corrosion by halogen gases, and a steel for the preparation thereof.

It is desirable to control or reduce the combustibility of plastic products. A test method for determining combustibility is prescribed in Underwriters' Laboratories Standard (UL-94V).

Efforts have been made to impart flame-retardability or self-extinguishability to thermoplastic resins of low softening point and high fluidity by incorporating therein a halogenated (chlorinated or brominated) aliphatic or aromatic hydrocarbon together with a phosphoric acid ester or an antimony compound. In the thermoplastic resin containing flame-retarding agent, a part of the flame-retarding agent is decomposed during injection molding to evolve a halogengas or gaseous halogen compound which causes pitting on the cavity walls of the mold. Tough steels such as SAE 1055 and SAE 4135 have been employed as steels for molds used in plastic molding. However, these steels are not resistant to pitting. Although chromium plating is effected to prevent pitting, this technique is not so effective, since the corrosive gas permeates into microvoids of the coating layer to corrode the base steel. Employment of a stainless steel such as SAE 30304 has also been attempted, but stainless steel is unsatisfactory with respect to strength and workability. Under the above described circumstances, a strong need has been felt for a mold for plastic molding having an excellent resistance to corrosion by halogen gases or halogen compound and for a steel for the preparation thereof having a high toughness and workability.

SUMMARY OF THE INVENTION

An object of the present invention is to provide a mold for plastic molding having improved resistance to corrosion by halogen gases or halogen compound generated during injection molding of a thermoplastic synthetic resin containing a flame-retarding agent having halogen.

Another object of the invention is to provide a steel for the preparation of molds for plastic molding having an improved resistance to corrosion by said halogen compounds.

Still another object of the invention is to provide a steel of an improved machinability and/or toughness for the preparation of said molds for plastic molding.

DETAILED EXPLANATION OF THE INVENTION

The objects of the present invention can be attained by preparing the following steel:

(1) a steel of a basic alloy composition consisting essentially of up to 0.05% carbon, up to 1.0% silicon, up to 2.0% manganese, 5.0–8.0% nickel, 11.0–15.0% chromium, 1.0–4.0% molybdenum, 0.5–4.0% copper, 0.5–2.0% cobalt and the balance iron;

(2) a steel of the above basic alloy composition further incorporating at least one machinability-improving component selected from the group consisting of 0.03–0.30% lead, 0.01–0.20% tellurium, 0.002–0.020% calcium and 0.03–0.40% bismuth;

(3) a steel of the above basic alloy composition further incorporating at least one toughness and hardness-improving component selected from the group consisting of up to 3.0% tungsten, up to 0.01% boron, up to 0.5% titanium, up to 0.5% vanadium, up to 0.5% niobium and up to 0.5% tantalum; or (4) a steel of the above basic alloy composition further incorporating at least one of said machinability-improving components and at least one of said toughness and hardness-improving components; or by preparing a mold for plastic molding from any of said steels and subjecting the same to age-hardening treatment at 450°–550° C.

Reasons for limiting the amounts of elements in the alloy composition of the steel of the present invention are as follows:

(1) Carbon: up to 0.05%

The upper limit is fixed at 0.05% because (a) the smaller the amount of carbon, the higher is the corrosion resistant effect, (b) the matrix of steel containing carbon within said limit is advantageously converted to massive martensite by heat treatment thereby increasing toughness thereof and (c) steel containing carbon within said limit can be produced without necessity of a special decarburization process in the smelting step.

(2) Silicon: up to 1.0%

The upper limit is fixed at 1.0% because excessive silicon reduces toughness, ductility and hot-workability, though silicon acts as an deoxidizing element like manganese in the smelting step, thereby enhancing resistance to oxidation and also resistance to stress corrosion cracking.

(3) Manganese: up to 2.0%

Manganese acts as an deoxidizing element like silicon in the smelting of stainless steel. Further, in the presence of a machinability-improving component such as sulfur or selenium, manganese reacts therewith to form an inclusion which is effective for prevention of hot fragility. Thus, manganese is included in an amount up to 2.0%.

(4) Copper: 0.5–4.0%

Figure 1:
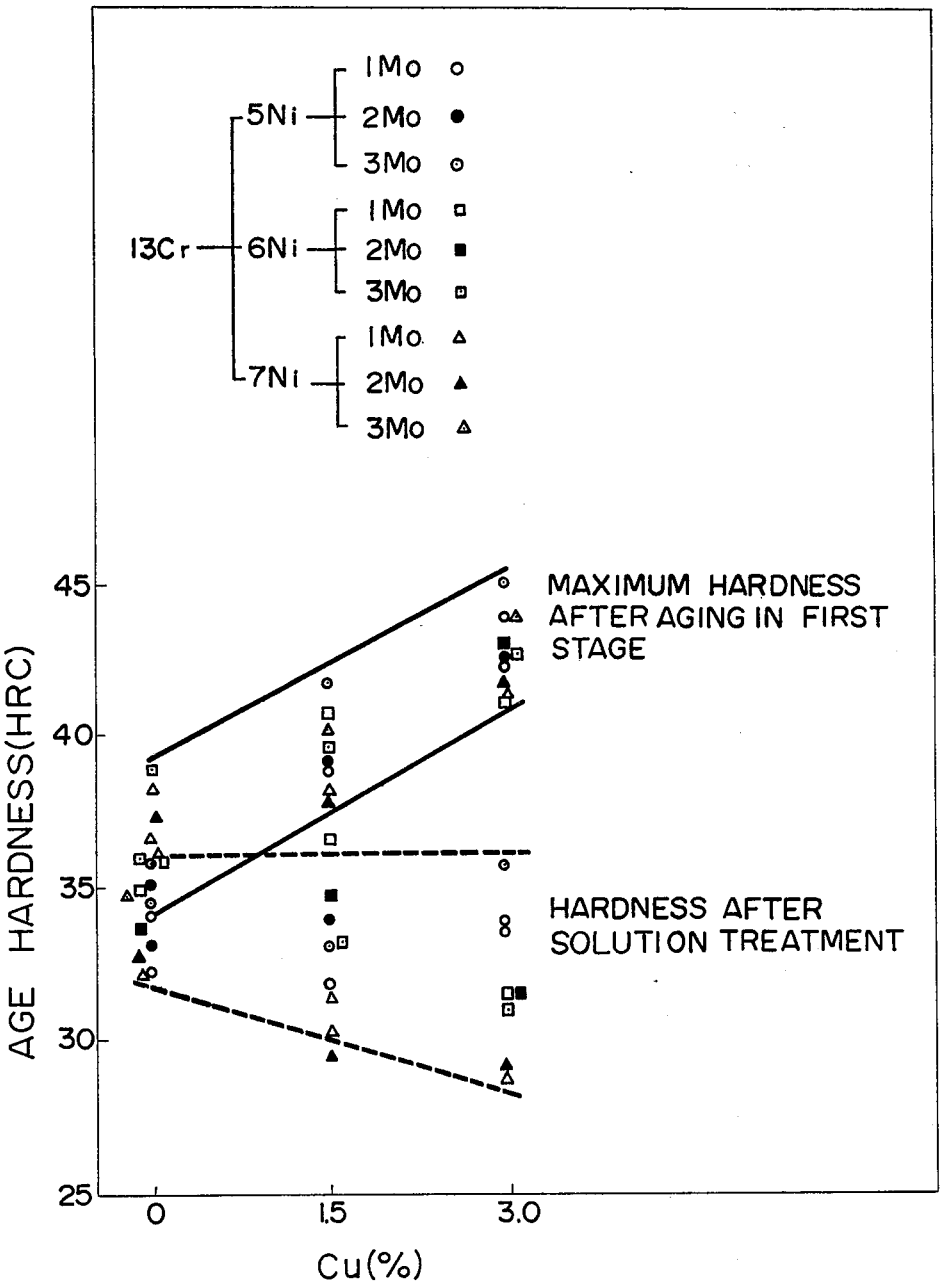
FIG. 1 shows the affects of Cu on age-hardness of 13Cr-5/7Ni-⅓Mo steels.

As shown in FIG. 1, copper, which improves age-hardness in the first step by synergism with nickel and molybdenum, should be incorporated in an amount of at least 0.5%. However, at a Ni/Cu ratio of less than 1.5, hot workability is damaged. Thus, the upper limit is fixed to 4.0%.

(5) Nickel: 5.0–8.0%

In the presence of molybdenum, nickel imparts age-hardenability in the second step to the alloy, thereby preventing softening of the mold due to overaging. However, at a Ni/Cu ratio of less than 1.5, δ-ferrite is apt to be formed to reduce hot workability. Therefore, more than about 5.0% of nickel is required for obtaining Ni/Cu ratio of higher than 1.5. On the other hand, in the presence of excessive nickel, austenite residue is increased at room temperature to damage age hardness in the first step. Thus, the upper limit is fixed to 8.0%.

(6) Molybdenum: 1.0–4.0%

Figure 2:
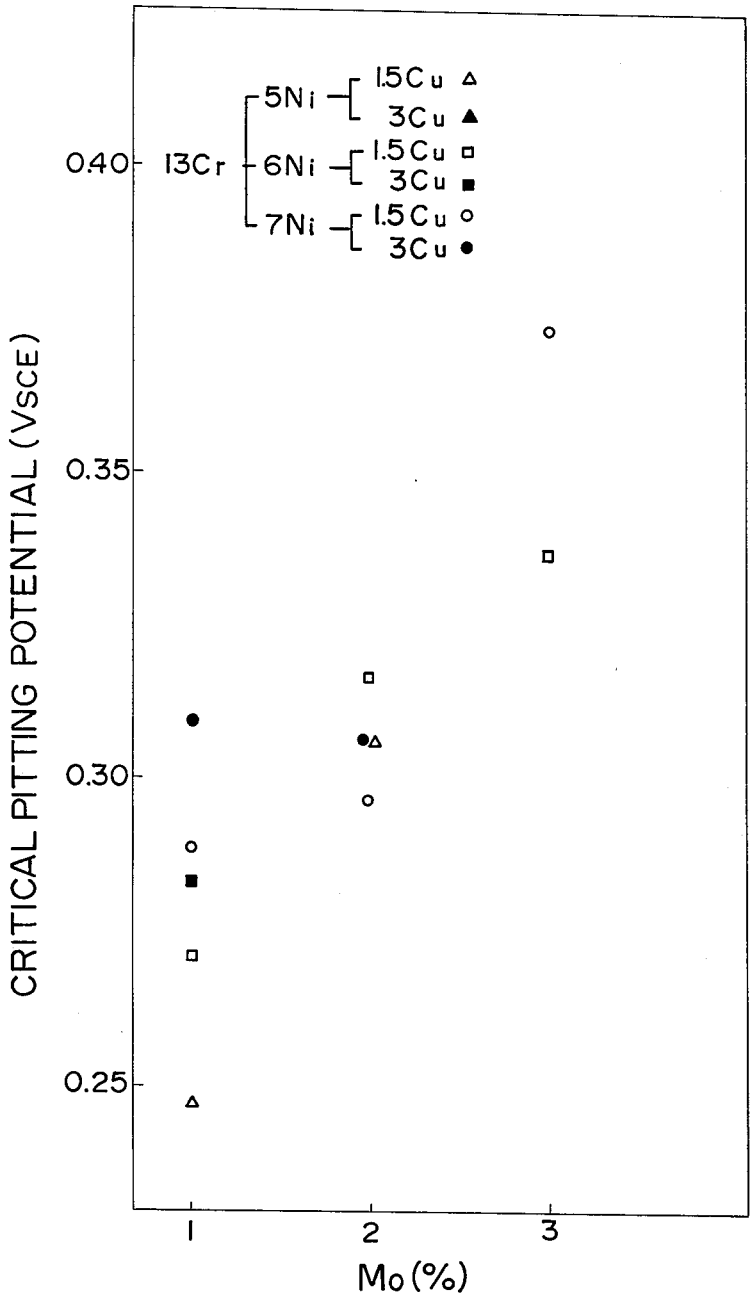
FIG. 2 shows the affects of Mo on pitting potential of 13Cr-5/7Ni-1.5/3.0Cu steels.

In the presence of nickel, molybdenum forms $Ni_3Mo$ precipitate to increase age-hardness in the second step and thereby prevent softening of the mold due to over-aging. Molybdenum has an effect of enhancing pitting potential of 13Cr-5/7Ni-Cu steel, as shown in FIG. 2, and should be contained in an amount of more than 1.0%. On the other hand, excessive molybdenum impairs the hot workability, and therefore, molybdenum content should not exceed 4.0%.

(7) Chromium: 11.0–15.0%

In the presence of nickel, the corrosion resistance effect of chromium is secured. More than 11.0% of chromium is thus required. However, excessive chromium above 15.0% causes the formation of a large amount of δ-ferrite in the matrix, since the nickel content is limited to 5.0–8.0%. With due regard to this point, chromium content is limited to 11.0–15.0%.

(8) Cobalt: 0.5–2.0%

In 13Cr-7Ni-3Mo-1.5Cu steel, at least 0.5% of cobalt is indispensable, since cobalt accelerates $Ni_3Mo$ precipitation, increases age-hardness in the second step and prevents softening due to excessive aging to stabilize the heat treatment. However, increasing the amount of cobalt to more than 2.0% does not result in a proportional increase in effect but only raises the cost of the steel. The upper limit is thus fixed to 2.0%.

(9) Lead: 0.05–0.30%, tellurium: 0.01–0.20%, calcium: 0.002–0.020% and bismuth: 0.03–0.40%

One or more of these alloy components are selected and used within the above ranges for securing the effect of increased machinability (tool life and chip breakability) without damaging precipitation hardness and corrosion resistance of the basic alloy composition. If these alloy components (exclusive of calcium) are distributed uniformly as metal particles or non-metal inclusions, an antifriction effect is provided between the cutting edge of the tool and the chips to prolong the life of the tool. Calcium exhibits principally the effect of protecting the tool from wear, since calcium inclusion (i.e. calcium oxide) is softened and sticks to the cutting edge of the tool. In addition, calcium improves hot workability.

(10) Tungsten: up to 0.5%, boron: up to 0.01; titanium: up to 0.5%, vanadium: up to 0.5%, niobium: up to 0.5% and tantalum: up to 0.5%

One or more of these carbide-forming alloy components are incorporated in the alloy for the purpose of increasing toughness and hardness without damaging the intrinsic precipitation hardness or corrosion resistance of the steel of the basic alloy composition of the invention. If these alloy components are used excessively beyond the respective upper limits, hot workability of the steel of the invention is damaged and cost of the steel increases.

The following example will further illustrate the present invention.

EXAMPLE

Steel samples of chemical compositions as shown in Table 1 were prepared in a laboratory smelting furnace. After hot rolling, the following properties were examined.

TABLE 1

| | Steel No. | C (%) | Si | Mn | P | S | Cu | Ni | Cr | Mo | Co | Others | Remarks |
|---|---|---|---|---|---|---|---|---|---|---|---|---|---|
| Steel of the invention | S-1 | 0.033 | 0.40 | 0.41 | 0.016 | 0.013 | 1.45 | 7.08 | 12.95 | 2.82 | 0.86 | — | Claim (1) |
| | S-2 | 0.031 | 0.45 | 0.40 | 0.016 | 0.014 | 1.48 | 7.12 | 12.99 | 2.80 | 0.95 | Ca 0.0096 | Claim (2) |
| | S-3 | 0.014 | 0.30 | 0.33 | 0.023 | 0.026 | 1.50 | 6.88 | 12.80 | 3.09 | 1.06 | B 0.005 | Claim (3) |
| Comparative steel | C-1 | 0.050 | 0.39 | 0.55 | 0.028 | 0.012 | 3.02 | 4.80 | 15.89 | 0.19 | — | — | (17-4PH) |
| | C-2 | 0.42 | 0.30 | 0.75 | 0.020 | 0.015 | 0.08 | 0.03 | 0.98 | 0.20 | — | — | 4140 |

Figure 3:
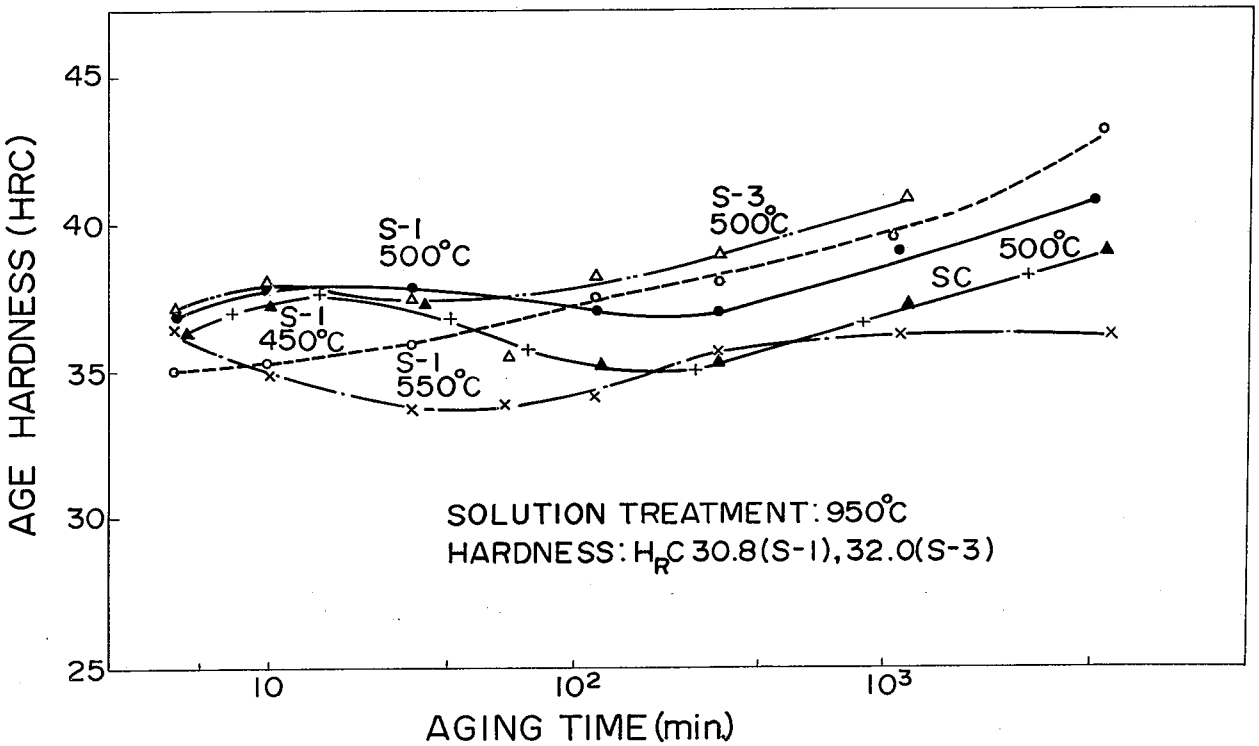
FIG. 3 shows age-hardness of the steels of the present invention.
Figure 4:
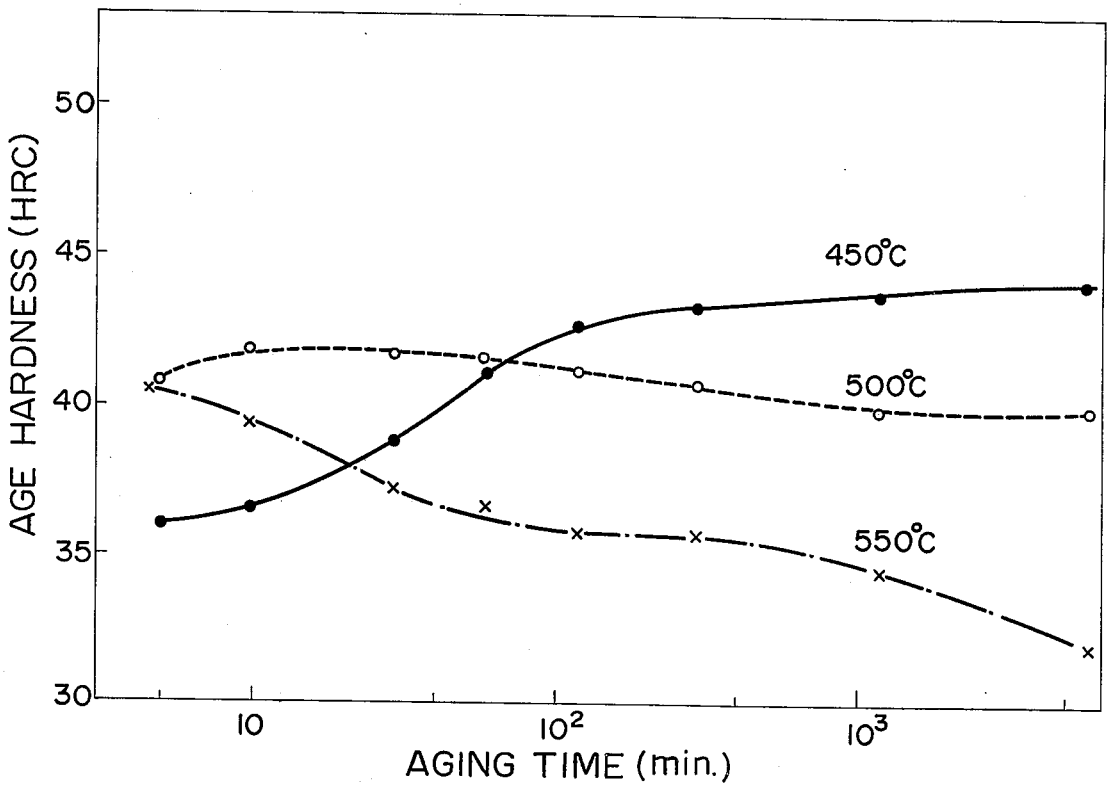
FIG. 4 shows age-hardness of a comparative steel.

(1) Age-hardness:

Age-hardnesses of steels of the present invention (S-1 and S-3) after solution treatment at 950° C.×one hour AC followed by aging at 450° C., 500° C. and 550° C. are shown in FIG. 3. Age-hardness of a comparative steel (C-1:17-4PH) after solution treatment at 1,040° C.×30 min. AC followed by aging at the same temperatures as above is shown in FIG. 4. From FIGS. 3 and 4, it is apparent that in the control steel, aging hardness is lowered and over-aging is caused as aging temperature increases and aging time is prolonged. On the other hand, the steel of the invention (S-3) has a special feature that is not over-aged at a temperature in the aging temperature range of the control steel. This is considered to be due to the effects of Mo and Co added.

Comparing Sample S-1 (.) with Sample SC (▲) of nearly the same composition as S-1 but containing no Co after aging treatment at 500° C., age hardening in the second step is remarkable in the former due to Co as shown in FIG. 3.

(2) Machinability:

Of the steel samples shown in Table 1, Samples S-1 and S-2 were subjected to solution treatment at 980° C. and then to aging at 500° C. to obtain $H_RC$ hardness of about 35–36, and Sample C-1 was subjected to solution treatment at 1,040° C. and then to aging at 580° C. to obtain $H_RC$ hardness of 35.5. Thereafter, their machinabilities, which indicate engraving workability, were examined. It was confirmed, as a result, that Sample S-2 containing Ca as machinability-improving component was quite excellent as shown in Table 2.

TABLE 2

| Cutting Tool | | Slitting Saw | | | Milling Cutter | | |
|---|---|---|---|---|---|---|---|
| Test piece No. | | S-1 | S-2 | C-2 | S-1 | S-2 | C-2 |
| Tool life (min) | | 25 | 80 | 26 | A[1]610 | 3,200 | 80 |
| | | | | | B[2]1,090 | 1,750 | 80 |
| | | | | | C[3]10 | 200 | 60 |
| Test Conditions | Type of tool | AISI M2 | | | AISI M2 | | |
| | Shape of cutter | 60mm(outside diameter) × 25.4mm(inside diameter) × 2mm(thickness) × 34(number of blades) | | | Straight shank | | |
| | Feed | 0.0174mm/Blade | | | 0.01–0.04mm/Blade | | |

TABLE 2-continued

| | | |
|---|---|---|
| Depth of cut | 0.8mm | 1.0mm |
| Cutting velocity | 70mm/min | 28.7mm/min |
| Cutting oil | dry | dry |
| Evaluation of tool life | melting of tool | melting of tool |

[1]Cutting length (mm) at a feed of 0.01 mm.
[2]Cutting length (mm) at a feed of 0.03 mm.
[3]Cutting length (mm) at a feed of 0.04 mm.

(3) Corrosion Resistance:

(a) Resistance to hydrochloric acid:

Of the steel samples shown in Table 1, Samples S-3 (subjected to solution heat treatment at 950° C. and then to aging at 500° C. for one hour) and C-1 (subjected to solution heat treatment at 1,050° C. and then to aging at 500° C. for one hour) were immersed in boiling 10% HCl solution for 6 hours continuously and then corrosion losses were determined. The results are shown in Table 3. It is apparent from Table 3 that corrosion loss after the aging treatment of Sample S-3 is less than that of Sample C-1.

TABLE 3

| | (mg/cm$^3$) | |
|---|---|---|
| | Solution Heat Treatment | After Aging |
| S-3 | 152 | 231 |
| C-1 | 144 | 358 |

(b) Resistance to Pitting:

Pitting potentials of said samples (S-2 and C-1) were determined in a 3% aqueous NaBr solution (kept at 35° C.) adjusted to pH 2.0. The results thereof shown in Table 4 indicate that Sample S-2 had superior pitting resistance to Sample C-1.

TABLE 4

| | S-2 | C-1 |
|---|---|---|
| Solution heat treatment | +0.356 $V_{SCE}$ | +0.380 $V_{SCE}$ |
| After aging (500° C. × 2 mins) | +0.421 $V_{SCE}$ | +0.233 $V_{SCE}$ |
| After aging (500° C. × 5 mins) | +0.373 $V_{SCE}$ | +0.241 $V_{SCE}$ |
| After aging (500° C. × 30 mins) | +0.387 $V_{SCE}$ | +0.219 $V_{SCE}$ |
| After aging (500° C. × 60 mins) | +0.370 $V_{SCE}$ | +0.207 $V_{SCE}$ |

Then, an aqueous ferric chloride solution (pH=1.3) was prepared. Samples S-2 and C-1 were immersed in the aqueous solution kept at a constant temperature (35° C.) for 48 hours continuously. Thereafter, corrosion losses were determined. The results thereof shown in Table 5 indicate that Sample S-2 had superior pitting resistance to Sample C-1.

TABLE 5

| | (mg/cm$^3$) | |
|---|---|---|
| | S-2 | C-1 |
| As solution treatment | 50.7 | 75.2 |
| After aging (500° C. × 5 mins) | 40.1 | 54.8 |
| After aging (500° C. × 30 mins) | 42.2 | 59.9 |
| After aging (500° C. × 60 mins) | 44.1 | 62.6 |

(c) Change in tint of wrapping-finished mold:

Molds made of the steels of the present invention (S-1 and S-4) and the control steels (C-1 and C-2) of the samples shown in Table 1 were fitted to an injection molding machine for vinyl chloride resin and exposed to chlorine gas atmosphere (concentration: 30–40% $Cl_2$) to evaluate change in tint of the surface. In Samples S-1, S-4 and C-1, discoloration was hardly recognized after work for 2,000 hours in total, though C-2 was discolored considerably after work for 4 hours.

Figure 5:
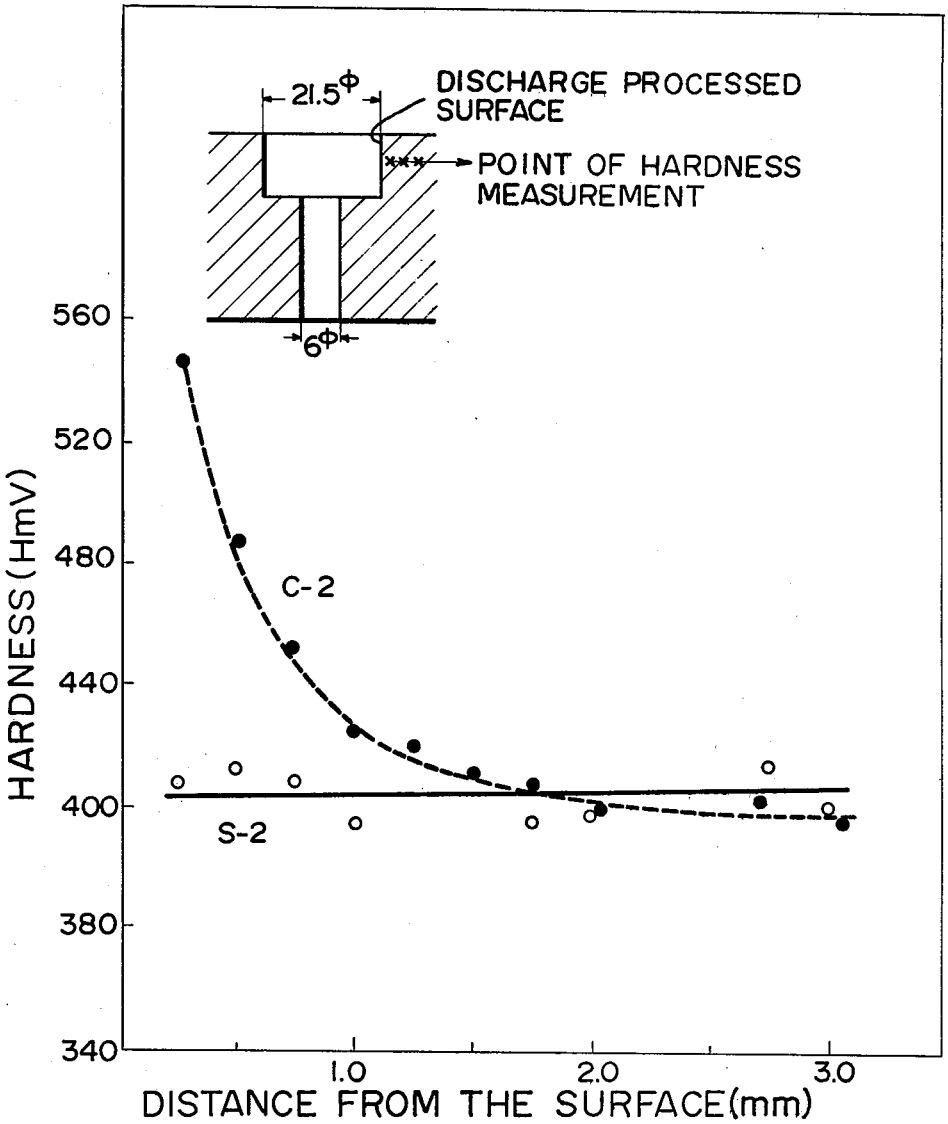
FIG. 5 shows a comparison in hardness of cross section of molds after discharge processing.

(4) Discharge-processing workability:

In many cases, steel for molds used in plastic molding is subjected to quenching and tempering to obtain a desired hardness and then to discharge-processing at the time of treating the mold cavity. During the discharge-processing, a hardened surface layer is formed to cause an increase in number of mirror plane polishing steps required. However, the steels of the invention have age-hardening property and almost no hardened surface layer is formed during the work. This fact is shown in FIG. 5.

(5) Utility test:

A mold for injection molding was prepared from a steel of the present invention and fitted to a one ounce injection molding machine MS-16 (a product of Meiki Seisaku-sho). After injection molding with the machine, life of the mold was compared with a mold made of conventional 1055 steel and a chromium-plated mold of 1055 steel. Resin used was an ABS resin, Tufflex. Molten resin temperature was 197°±2° C. Molding was effected for 7–12 hours a day followed by rust preventing treatment, according to interrupted molding operation.

Corrosion resistance was determined by measuring the depth of marks on the walls of the cavity of the mold caused by corrosion with a surface roughness meter. The results are shown in FIG. 6.

Figure 6:
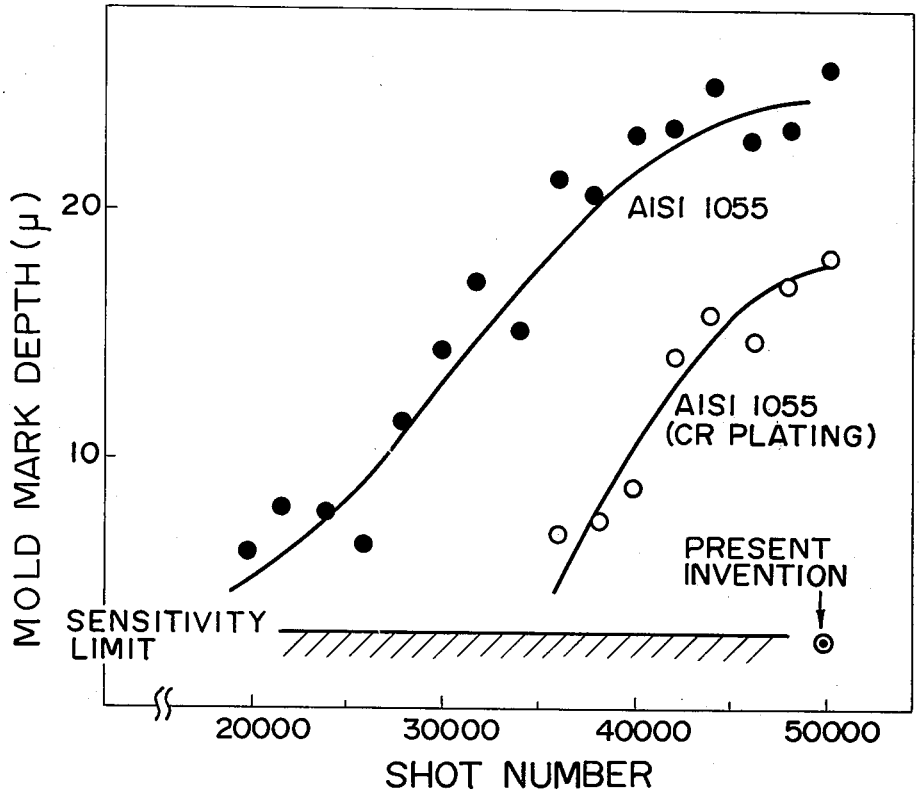
FIG. 6 shows change in depth of marks on the walls of the mold cavity caused by corrosion.

It is apparent from FIG. 6 that the mold of the present invention has an average life about 10 times as long as 1055 steel mold and about 5 times as long as chromium-plated 1055 steel mold.

We claim:

1. A massive martensite steel for a mold for plastic molding consisting of up to 0.05% carbon, up to 1.0% silicon, up to 2.0% manganese, 5.0–8.0% nickel, 11.0–15.0% chromium, 1.0–4.0% molybdenum, 0.5–4.0% copper, 0.5–2.0% cobalt, at least one machinability-improving component selected from the group consisting of 0.03–0.30% lead, 0.01–0.20% tellurium, 0.002–0.020% calcium, and 0.03–0.40% bismuth, at least one toughness and hardenability-improving component selected from the group consisting of up to 3.0% tungsten, up to 0.01% boron, up to 0.5% titanium, up to 0.5% vanadium, up to 0.5% niobium, and up to 0.5% tantalum, and the balance iron and inevitable impurities, which exhibits a hardness of $H_RC$ 30 or higher after age-hardening treatment at 450°–550° C. and resistance to corrosion by halogen gas.

2. A massive martensite steel for a mold for plastic molding consisting of up to 0.05% carbon, up to 1.0% silicon, up to 2.0% manganese, 5.0–8.0% nickel, 11.0–15.0% chromium, 1.0–4.0% molybdenum, 0.5–4.0% copper, 0.5–2.0% cobalt, at least one toughness and hardenability-improving component selected from the group consisting of up to 3.0% tungsten, up to 0.01% boron, up to 0.5% titanium, up to 0.5% vanadium, up to 0.5% niobium, and up to 0.5% tantalum, and the balance iron and inevitable impurities, which exhibits a hardness of $H_RC$ 30 or higher after age-hardening treatment at 450°–550° C. and resistance to corrosion by halogen gas.

3. A massive martensite steel for a mold for plastic molding consisting of up to 0.05% carbon, up to 1.0% silicon, up to 2.0% manganese, 5.0–8.0% nickel, 11.0–15.0% chromium, 1.0–4.0% molybdenum, 0.5–4.0% copper, 0.5–2.0% cobalt, at least one machinability-improving component selected from the group consisting of 0.03–0.30% lead, 0.01–0.20% tellurium 0.002–0.020% calcium, and 0.03–0.40% bismuth, and the balance iron and inevitable impurities, which exhibits a hardness of $H_RC$ 30 or higher after age-hardening treatment at 450°–550° C. and resistance to corrosion by halogen gas.

4. A massive martensite steel for a mold for plastic molding consisting of up to 0.05% carbon, up to 1.0% silicon, up to 2.0% manganese, 5.0–8.0% nickel, 11.0–15.0% chromium, 1.0–4.0% molybdenum, 0.5–4.0% copper, 0.5–2.0% cobalt and the balance iron and inevitable impurities, which exhibits a hardness of $H_RC$ 30 or higher after age-hardening treatment at 450°–550° C. and resistance to corrosion by halogen gas.

* * * * *